United States Patent [19]

Conklin et al.

[11] 4,398,605

[45] Aug. 16, 1983

[54] FIRE EXTINGUISHING COMPOSITION AND METHOD

[75] Inventors: Michael T. Conklin, South New Berlin; Charles F. Mowry, Rome, both of N.Y.

[73] Assignee: Fire Out Enterprises Company, Inc., Norwich, N.Y.

[21] Appl. No.: 304,891

[22] Filed: Sep. 23, 1981

Related U.S. Application Data

[63] Continuation of Ser. No. 129,584, Mar. 12, 1980, abandoned.

[51] Int. Cl.[3] ..... A62C 1/00

[52] U.S. Cl. ..... 169/47; 106/18.11; 252/3; 252/8.05

[58] Field of Search ..... 106/18.11, 15.05; 252/3, 8.05; 169/44, 47

[56] References Cited

U.S. PATENT DOCUMENTS

| | | | |
|---|---|---|---|
| 2,677,700 | 5/1954 | Jackson | 252/174.21 |
| 3,061,548 | 10/1962 | Dravnieks | 252/174.21 |
| 3,418,254 | 12/1968 | Bishof et al. | 252/392 |
| 3,541,010 | 11/1970 | Dingman et al. | 252/3 |
| 3,562,156 | 2/1971 | Francen | 252/8.05 |
| 3,578,590 | 5/1971 | Nienker et al. | 252/3 |
| 3,772,195 | 11/1973 | Francen | 252/2 |
| 3,912,647 | 10/1975 | Adell | 252/2 |
| 4,090,967 | 5/1978 | Falk | 252/2 |
| 4,099,574 | 7/1978 | Cooper et al. | 252/8.05 |

*Primary Examiner*—Lorenzo B. Hayes

*Attorney, Agent, or Firm*—Lalos, Leeds, Keegan, Lett & Marsh

[57] ABSTRACT

A fire fighting composition and method for spraying a low volume liquid stream without foam onto a fire that conserves the volume of fluid used and yet more quickly snuffs out the fire. The fire fighting composition is formed from a concentrate comprising one or more nonionic surfactants having a combined cloud point of 68° F.–212° F. and sufficient water to form a concentrate solution of not greater than 30% by weight of the surfactant. The ultimate fire fighting composition is formed from the concentrate and passed through a conventional pump. A fire fighting solution is formed having not greater than 0.2% by volume of the surfactant that does not cause undesirable foaming or cavitation of the pump due to the low concentration of the surfactant. The fire fighting solution in this form is sprayed onto fires to form an effective means for combatting fires while achieving high versatility for conventional fire fighting pumping apparatus.

11 Claims, No Drawings

FIRE EXTINGUISHING COMPOSITION AND METHOD

This is a continuation of application Ser. No. 129,584, filed Mar. 12, 1980, now abandoned.

BACKGROUND OF THE INVENTION

This invention relates broadly to fire fighting compositions and methods of applying them. More particularly the present invention relates to a fire fighting solution of improved characteristics in extinguishing fires and permitting greater versatility in the use of conventional fire fighting equipment.

It is not commonly known that fires encountered in the public or private areas throughout the world have been increasingly difficult to extinguish particularly in the last several decades as compared to those fires encountered earlier. It has been found for instance that the material contents of inhabited areas now in existence are often of a very different chemical content or origin than those used previously. In particular, it is the use of synthetic materials which has been increasing of late at the expense of natural materials that has posed a serious problem for the professional fire fighter and public administrators.

New materials used either for construction or decoration have often been found to burn with a hotter flame making fire fighting difficult at best and often times impossible either to salvage precious lives or property. These hotter and more ravaging conditions pose an even greater threat to life due to the prospect of noxious and lethal fumes given off by many of the materials commonly found in these inhabited areas. The combination of the hotter fires and the lethal fumes poses greater problems to combat resulting in fires of greater duration that are often much more than even the most highly skilled and far better trained fire fighter of today is able to cope with for protection of life and property. The time elapsed before extinguishment is particularly important not only to prevent further damage but to stop the evolution of the lethal fumes that are hazards both to the inhabitants and to the fire fighter. Quick and effective fire extinguishment is the only solution.

An ideal fire fighting system will comprise a fire fighting liquid that extinguishes a fire quickly and in particular, cool the fire so that the high heat generated is rapidly reduced. Conventional compositions that may contain various surfactants have not been able satisfactorily to extinguish the fire in acceptable time nor to cool down the fire sufficiently to limit the lethal fumes. Adell, U.S. Pat. No. 3,912,647, for instance, discloses fire fighting compositions containing high concentrations or surfactants blended into a solvent and mixed with water to a viscous substance that is produced in an attempt to blanket the fire. A solvent such as naptha must be used to make the viscous gel flowable. Such high concentrations, in the range of about 3% or more surfactant do not satisfy current fire fighting requirements.

Fire fighting systems and equipment currently available unfortunately have also not matched the rise either in the risk of tragic losses through raging fires or the risks required of the fire fighter. A few new foam making compositions and mechanical systems have been made available in recent years to attack fires but again fire fighting capabilities have not been improved significantly. For instance, fire fighting agents commonly known as aqueous film forming foams (AFFF) are currently in use for application to Class A or Class B fires. However these foams and any other foams have particular drawbacks relating to the rapidity of fire extinguishment and to the means of application when using conventional pumping and discharge equipment.

It is typical of the foam making concentrations that a particular concentrate containing a foam making material such as the fluorinated surfactants are educted into one of a plurality of discharge lines from the commonly used centrifugal pump mounted on the fire truck. The metering means for supplying the desired concentration of the foam making concentrate educted from a supply tank into the discharge line must be sufficiently accurate to provide the desired concentration of the foam making composition. For each of the discharge lines a similar metering and eduction system must be present. These additional metering and eduction systems add substantially to the cost of the fire fighting system and use up valuable space on the fire truck. More importantly, such systems diminish the pump pressure and pump capacity on the fire fighting fluid being discharged thus limiting the distance to which the fire fighting fluid may be dispensed.

Other fire extinguishing foam compositions are known that utilize various nonionic surfactants as additives to aid emulsification and reduce costs when combined with fluorinated surfactants, solvents and foam stabilizing agents. Francen, U.S. Pat. No. 3,772,195, Falk, U.S. Pat. No. 4,090,967 disclose examples of such compositions producing low expansion foams. Typically these formulations are applied through nozzles proportioning 1%, 3% and 6% amounts of the foaming concentrate into the water stream. The nonionic surfactants disclosed in these patents are useful only when combined with fluorinated surfactants because they do not have sufficient wetting ability alone to wet the surfaces of burning organic liquids.

Other U.S. patents such as Dingman, U.S. Pat. No. 3,541,010 and Nieneker, et al., U.S. Pat. No. 3,578,590 disclose additional foam compositions formed from mixtures of ethoxylated alkylphenols and solvents to extinguish fires arising from Class A and B materials. The composition is formed from a concentrate containing a maximum of 30% water necessitating the presence of a solvent to prevent the nonionic ethoxylated alkylphenol from gelling. The concentrate disclosed in the patents produces a foam in which about 0.5 to about 6% by volume of the product exists in the discharged stream.

In every instance such foam formulas are applied into the water stream on only the discharge side of the pump. If the foam formulas are not applied to the water stream on the discharge side of the pump but rather at the intake side excessive foam results causing cavitation of the pump and a total loss of output. Thus each foam discharge line must have its own metering and eductor apparatus which for practical purposes limits the use of only one such foam discharge line on the fire truck for each pump. Typically the requirement of a separate proportioning eductor and foam concentrate supply for each discharge line from the pump is too expensive and requires additional space that is not available. The use of only a single foam line severely limits the effectiveness of the fire fighting apparatus because other discharge lines spraying water would wash away foam sprayed from the single discharge line or else only the single foam line would be used reducing the capability of the fire fighter in extinguishing the fire in the shortest period of time.

Another factor that must be considered as being important to achieve an ideal fire fighting system is the volume of fire fighting solution used to extinguish the fire. This volume may be a critical factor in remote locations where access to water is limited to a portable supply tank accompanying the fire pumper truck. Use of lower volume also is of significant importance in avoiding the extensive water damage commonly experienced by property owners following conventional attempts to extinguish the fire. Fire insurance rates reflect to some extent the fact that in some instances water damage is more detrimental to property than the fire.

OBJECTS OF THE INVENTION

It is the principal object of the present invention to provide a method and composition that enables those engaged in fire fighting to utilize conventional equipment to the fullest extent to extinguish fires in shorter periods of time.

It is also an object of the present invention to provide a concentrate solution and method for fighting fires whereby the concentrate solution can be added on the intake side of the pump without causing excessive foam or cavitation of the pump to produce a fire fighting solution to be sprayed onto the fire.

It is also an object of the present invention to provide both a composition of a fire fighting solution and method for fighting fires by producing the fire fighting solution having a very low level of a nonionic surfactant capable of more efficiently and economically fighting Class A, B and D fires.

This invention also has as an object the provision of a fire fighting solution that rapidly extinguishes a fire and has a unique cooling effect on the combustible surfaces.

SUMMARY OF THE INVENTION

A fire fighting composition and method for spraying a liquid stream without foam in order more efficiently and effectively to extinguish fires using low volumes of liquid. The fire fighting composition is formed from a concentrate comprising one or more nonionic surfactants having a combined cloud point of 68° F.–212° F. and sufficient water to form a concentrate solution of not greater than 30% by weight of the surfactant. The ultimate fire fighting composition is formed from the concentrate and added to the intake side of a conventional pump. A fire fighting solution is formed having not greater than 0.2% by volume of the surfactant that does not cause undesirable foaming or cavitation of the pump due to the low concentration of the surfactant. The fire fighting solution in this form is sprayed onto fires to form an effective means for combatting fires while achieving high versatility for conventional fire fighting pumping apparatus.

DETAILED DESCRIPTION OF THE INVENTION

The fire fighting composition of the present invention comprises very low aqueous concentrations of one or more nonionic surfactants having a combined cloud point between 68° F.–212° F. The fire fighting compositions are formed as aqueous solutions from a concentrate solution of the surfactant. This concentrate solution is made available on the fire fighting apparatus and ready for use by eduction, for instance, into water stream on the intake side of the conventional pump for spraying discharge through each conventional discharge line without excessive foaming or cavitation of the pump.

The surfactants useable for the present invention include those nonionic surfactants having a cloud point between 68° F.–212° F. or which when combined produce a composite cloud point in that range. A cloud point below 68° F. for the sole or combination of surfactants would render them not sufficiently soluble to be useful. Nor would a surfactant with a cloud point above 212° F. which loses its fire extinguishing capability. However, it is possible that a combination of more than one nonionic surfactant, each of which has a cloud point outside the specified range, but which together produce a composite cloud point within the range will be sufficiently soluble and effective for the fire fighting purposes of this invention.

In general it has been found that the surfactants useful to perform functions of the present invention are primarily, although not exclusively, those obtained through the condensation of ethylene oxide or propylene oxide with various substances and particularly with phenolic compounds having a side chain. Among the substances are the following: fatty acids such as stearic, lauric, palmitic, etc.; fatty alcohols such as mannitol, sorbitol, etc.; primary, secondary or tertiary alcohols such as ethanol, isopropyl or isobutyl alcohols, etc.; fatty amines or amides; alkylolamines and block copolymers with ethylene and propylene oxides with M.W. of 1100–15,500, block copolymers of oxypropylene oxyethylene polyols derived from ethylene diamine. Of particular usefulness are those surfactants produced by the condensation of ethylene oxide with alkylphenols. The alkyl group may have from 1 to 12 or more carbon atoms though particularly 6 to 9 carbon atoms is preferred such as octyl-, nonyl-, etc.

Combinations of one or more nonionics are selected to provide water solubility in the 68° F.–212° F. cloud point range and to provide the least amount of foam.

In the formation of the surfactant the quantity of the molecules of ethylene oxide may be varied from below 3 to up to 40 although preferably from 1.5 to 9.

In the practice of the present invention the concentrate solution is formed with not more than 30% by weight of the nonionic surfactant and preferably 20–29% by weight of the surfactant. If greater amounts of the surfactant are used such that the concentration is greater than 30% by weight of the surfactant in water, the surfactant forms a gel rendering it less useable if at all. It is therefore important to maintain the concentration of the nonionic surfactant at a maximum of 30% by weight.

It is this concentrate solution that is placed in a storage or supply tank and provided for use by the fire fighter on the fire truck. This solution concentrate when maintained in the storage tank at a maximum concentration of 30% by weight can be stored for ready use to form the fire fighting solution. It is from this storage tank that the concentrate is educted into the intake side of a conventional pump with its discharge lines each spraying a liquid stream onto the fire. Of course the concentrate solution can be premixed and taken into the pump at the intake side for spraying out through the discharge lines.

The concentrate solution has the unique characteristic of being able to be educted into the intake side of the pump rather than having to be educted into the nozzle of the discharge line. Such capability is believed for the first time to provide for the mixing and forming of the fire fighting solution at the intake side of the pump so that each of the discharge lines are capable of dispensing the fire fighting liquid stream without excessive foam or cavitation that would overheat and disable the pump. The need as in the prior art for individual eduction and metering means on each discharge line is negated with consequent economy and conservation of space on the fire truck. The fire truck pumper thus achieves greater versatility without being limited to a single type of discharge.

To use the concentrate solution, a conventional eductor or metering means is provided to the intake side of the conventional pump. The usual fire pumper trucks include pump capacities such as 250 gpm, 500 gpm, 750 gpm, 1000 gpm, 1250 gpm and 1500 gpm. In the 1500 gpm pumper, usually six 2½ inch lines each rated at a capacity of 250 gpm are provided. Before this invention when eductor equipment was used to feed prior compositions into the discharge line, the pipe size was reduced to 1½ inch having only a 100 gpm capacity. Thus with the proportioning and metering equipment installed that particular line is useful only for purpose of producing and spraying foam thereby diminishing the versatility of the fire pumper truck. In accordance with the present invention, however, each of the six 2½ inch discharge lines is useable to spray the fire fighting solution at its rated capacity.

The fire fighting solution is formed from the concentrate solution in an amount such that the fire fighting solution contains between 0.02% to 0.2% by volume of the surfactant. Preferably, the fire fighting solution would have the surfactant in the concentration of between 0.03% to 0.1% by volume. When premixed from the concentrate to the specified concentration, the pump draws in the premixed fire fighting solution.

Concentration of this surfactant in the fire fighting solution is important in enabling the fire to be extinguished very rapidly. It has been found that the low concentration enables the fire to be smothered or choked off by a cloud generated from the fire fighting solution. The fire is extinguished more rapidly than with any other fire fighting composition.

The low concentration of the nonionic surfactant in the fire fighting solution is also important because it enables the fire truck pump to pump the solution without excessive foam or cavitation that would damage the pump or limit the distance to which the water stream would be directed. To demonstrate the importance of the concentration not being greater than 0.2% by volume of the surfactant a surfactant concentration of 0.5% by volume such as disclosed in Nieneker, et al., U.S. Pat. No. 3,578,590 was used in a fire truck having a 500 gallon capacity. The particular nonionic used was a nonylphenol ethyoxylate with 9 moles of ethylene oxide. This provided 0.3% of the nonionic surfactant to the water stream and the mixture was pumped through a standard nozzle set at 60 gallons per minute. The mixture when added to the intake side of the pump and sprayed at a maximum distance of 55–60 feet as compared to a distance of 82 feet either with plain water or with the formulation of the present invention utilizing a maximum of 0.2% nonionic surfactant in the water. This illustrates that there was some foaming in the use of the prior art composition that caused a loss of pressure sufficient to reduce the spray distance.

Further to demonstrate the distinction between the present invention and the prior art composition, the hose nozzle was shut off as is conventional in fire fighting in some instances thus allowing the nonionic solution to circulate through the conventional bypass valve back into the water supply tank. In three minutes the pump began to overheat due to foam generated in the pump. The resulting cavitation in the pump would have damaged the pump and rendered it useless. When the nozzle was again open to the 60 gallon per minute flow rate a stream of 25–40 feet resulted. The water stream was not continuous but tended to spurt. After all the water was pumped out of the tank the tank gauge still registered full but inspection of the tank indicated that it was full of dense foam which gave the false indication of the quantity of the content of the tank. The foam so impeded the operation that even the refill of the tank was ineffective.

The following examples illustrate the effectiveness of this invention. It is understood that these examples are not intended to limit the scope of the invention.

Examples 1 and 2 were conducted with the fire extinguishing composition of the present invention which was formed from a concentrate composed by weight of 74% water, 21.0% nonylphenoxy polyethoxy ethanol, with 9 moles of ethylene oxides, 4.0% block polymer a nonylphenoxy polyethoxy ethanol having a mixture of condensation product with 3 and 9 moles of ethylene oxide, molecular weight 2900, cloud point 136° F. and 0.8% corrosion inhibitors, such as sodium nitrate and boramide (boric acid and monoethanol amine) and 0.2% biocidal inhibitors such as sodium 1-hydroxy pyridine-2-thione. The corrosion inhibitors may be conventional however a 2:1 to 1:2 ratio by weight of sodium nitrate and boramide from 0.1% to 3% by weight is adequate. The biocide may be present between 0.001%–1% by weight and may also include one or more of the following: sodium omadine-Olin Corp. (1-hydroxy pyridine-2-thione sodium salt); proxel CRL-ICI America (1,2 benzisothiazoline-3-one); Kathon 886-Microbiocide, Rohm & Haas (8.6% 5-chloro-2-methyl-4-isothiazoline-3-one) and 2.6% 2-methyl-4-isothiazoline-3-one). This mixture had a cloud point of 137° F. One gallon (1) of this concentrate was premixed with 500 gallons of water and drawn into the intake side of a pumper. This provides 0.2% of the concentrate solution or 0.05% by volume of the nonionic ingredients in the fire fighting solution.

EXAMPLE 1

A 10 foot diameter test pit was used. Ninety gallons of No. 2 fuel oil was added to the pit and ignited. It was allowed to burn for two minutes. This fire was extinguished using a commercial wetting agent in the extinguishing water. The fire was extinguished in 90 seconds using two pumper lines that deliver 100 gallons per minute. Water and wetting agent consumed was 300 gallons.

The pit was cleaned and recharged with 90 gallons of No. 2 fuel oil and allowed to burn for two minutes. It was extinguished in 20 seconds using the fire fighting solution. This solution was sprayed on the fire with one booster line at the rate of 23 gallons per minute without excessive foaming or cavitation. Only 8 gallons of this solution was required for extinguishment with a consumption of 0.016 gallons of the concentrate solution.

EXAMPLE 2

Wood was used as the combustible material. One hundred pounds of wood was treated with gasoline and ignited. It was allowed to burn for four minutes before extinguishment. A water stream was used to extinguish the wood using a booster line at 23 gallons per minute. Seventy-two seconds was required to extinguish.

A second pile of 100 pounds of wood was similarly ignited and allowed to burn four minutes. This was extinguished in eleven seconds using a booster line at 23 gallons per minute with water containing the above fire fighting solution without excessive foaming or cavitation. Examples 3, 4, 5, 6 and 7 were all tested using a concentrate solution by weight of 74% water, 23.5% nonyl phenoxy polyethylenoxy ethanol with 9 moles of ethylene oxide, 1.5% nonyl phenoxy polyethylenoxy ethanol with 1.5 moles of ethylene oxide and 1% of the same corrosion and biocidal inhibitors as in Examples 1 and 2. The concentrate solution has a cloud point of 92° F. One gallon of this solution was again premixed with 500 gallons of water to form the fire fighting solution having 0.05% by volume of the surfactant and passed through the pump from the intake side.

EXAMPLE 3

A fuel mixture of 125 gallons of a 50—50 mixture of No. 2 fuel oil and gasoline was put into a 12 foot diameter test pit. The mixture was ignited and allowed to burn for two minutes. It was extinguished first with a commercial AFFF foam using a 6% foam nozzle. Extinguishment was made in 31 seconds using the 6% solution applied at 100 gallons per minute. Fifty-one gallons of AFFF solution was used for a consumption of 3.06 gallons of AFFF product.

The pit was cleaned and recharged with 125 gallons of fuel, ignited and allowed to burn two minutes. It was extinguished in 28 seconds using the above described fire fighting solution. This fire fighting solution was sprayed on to the burning fuel through one booster line at the rate of 23 gallons per minute. A mere eleven gallons of extinguishing mixture was used which amounts to 0.022 gallons of product used.

EXAMPLE 4

The test consisted of burning two piles of tires. There were 200 tires in each pile. The piles were ignited with 5 gallons of a mixture of gasoline and motor oil. The piles were allowed to burn for 6 minutes which was sufficient to generate extreme heat and have the fire penetrate through the whole pile. The first pile was sprayed with plain water using two booster lines from one 500 gallons pumper. The water was pumped at the rate of 30 gallons per minute. The tank was pumped dry in 8 minutes and the fire was still out of control.

The second pile was sprayed with the fire fighting solution of the present invention. One booster line was used at the rate of 30 gallons per minute. The fire was completely extinguished in two minutes. Only sixty gallons of fire fighting solution was needed. This amounts to 0.12 gallons of the concentrate being used.

EXAMPLE 5

Fifteen pounds of magnesium was ignited with 80 pounds of wood. The fire was allowed 5.5 minutes to burn before extinguishment. Water was used to extinguish from one hose line at 30 gallons per minute. Twelve minutes was required to extinguish.

A second pile of magnesium was ignited similarly and allowed to burn for 5.5 minutes. It was extinguished with the above described solution. This solution was sprayed without excessive foam or pump cavitation on the fire at the rate of 23 gallons per minute and extinguishment was made in 2.5 minutes.

EXAMPLE 6

This test demonstrates the superior cooling ability of the present invention over that of water. One hundred thirty-five gallons (18.0468 cubic feet) of L.P. gas was used in each test. When released this L.P. gas expands 2500 times to produce 47117 cubic feet of gas. A 250 gallon L.P. tank was set up so that burning gas could be fed into the tank and allowed to escape through a valve at the other end.

It was estimated that the temperature of the burning gas was 2100° F. The test was to determine how long it would take to cool the tank to 80°–125° F. range, so that fire fighters could shut off the inlet and outlet valves.

In the first test, water was used from two hose lines at the rate of 125 gallons per minute from each line. Two hundred ten seconds was required to reduce the temperature of the tank and valves to the 80°–125° F. range. Eight hundred seventy-five gallons of water was used to cool it.

In the second test, another 47117 cubic feet of gas was ignited and passed through the 250 L.P. gas tank in the same manner. The tank was cooled to the 80°–125° F. range in 29 seconds using the invention. The concentrate was mixed one gallon to 500 gallons of water at the pump intake and sprayed onto the tank surface at the rate of 23 gallons per minute. Only eleven gallons of fire extinguishing solution was used to cool the tank. This amounts to 0.022 gallons of product used.

EXAMPLE 7

Several inches of water was put into a six foot by eight foot pit, and 15 gallons of gasohol added on top of the water. The gasohol was ignited and allowed to burn for 30 seconds. It was extinguished in 15 seconds with a commercial AFFF product pumped through a 6% foam nozzle at the rate of 90 gallons per minute. After extinguishment, the normally stable foam dissipated rapidly. 22.5 gallons of 6% AFFF solution was used. This amounts to 1.35 gallons of AFFF product used to extinguish.

A second test using 15 gallons of gasohol added on top of several inches of water in the 6 foot×eight foot pit was ignited and allowed to burn for 30 seconds. It was extinguished in 14 seconds using a concentrate solution as above described and mixed with water at the intake side of the pump at the rate of one gallon of formula/500 gallons of water. The extremely low volume of 5.4 gallons of this fire fighting solution was used for extinguishment which equals 0.0108 gallons of the concentrate solution.

The low volumes of fire fighting solution used in the above examples demonstrates the usefulness of the present invention in more remote areas without access to large volumes of water. Further the low volume of fire fighting solution would result in considerably less water damage compared to conventional fire fighting fluids.

Observations under the tests above and other fire fighting situations leads to the theory that the insolubility of the mixture at elevated temperatures creates a film of nonionic surfactant on the combustible mixture that is readily vaporized. This vapor expands many times more than if water was converted to steam. This vaporization generates a cloud around the fire and rapidly chokes off the fire by preventing air from supporting combustion. The phenomenon of the generation of this extinguishing vapor has a drastic cooling effect on combustible surfaces. For instance, burning materials extinguished with the composition of this invention can be held in the hand immediately after extinguishment whereas materials extinguished with water and other wetting agents of greater concentration are still too hot to touch. This invention allows fire fighters to quickly penetrate a burning building containing various Class A, B or D materials and rapidly extinguish the fire with a minimum use of water.

It should be clear that the effectiveness of this invention is not dependent upon foam. In fact, anti-foam agents have been used to demonstrate its usefulness as an extinguishing agent. It is inexpensive, works when diluted with high volumes of water, can be stored in the concentrate without corrosion or spoilage, can be mixed with water for ready to use solutions without danger of corrosion, can be diluted with hard or soft water, sea water or brackish water, and its fire extinguishing ability indicates a substantial improvement over the known art.

We claim:

1. A method of fire fighting comprising, preparing a concentrate consisting essentially of one or more nonionic, non film forming, surfactants having a combined cloud point of 68° F.–212° F. and sufficient water to form not greater than 30% by weight of a concentrate solution of said surfactant, mixing said concentrate with water to form a fire fighting solution of said surfactant not greater than 0.2% by volume of said surfactant and spraying said fire fighting solution on to a fire as at least one water stream without excessive cavitation causing foam.

2. The method of claim 1 including, said surfactant being selected from the group consisting of ethoxylated alcohols.

3. The method of claim 1 including, said surfactant being selected from the group consisting of nonylphenoxy polyoxyethylene ethanol containing from 1.5–40 moles of ethylene oxide.

4. The method of claim 1 including, said mixing of said concentrate with water being at the intake side of a pump for said spraying.

5. The method of claim 1, 2, 3 or 4 including, said surfactant being present in said fire fighting solution in an amount between 0.02 to 0.2% by volume.

6. The method of claim 1, 2, 3 or 4 including, passing said fire fighting solution through a pump and spraying said fire fighting solution through a plurality of discharge lines without producing cavitation in the pump.

7. The method of claim 6 including, said fire fighting solution having said surfactant in a concentration of 0.03% to 0.1% by volume.

8. The method of claim 1, 2, 3 or 4 including, said concentrate solution having 20% to 29% by weight of said surfactant.

9. The method of claim 1, 2, 3 or 4 including, said fire fighting solution having said surfactant in a concentration of 0.03% to 0.1% by volume, and said concentrate solution having 20% to 29% by weight of said surfactant.

10. The method of claim 6 including, said concentrate solution having 20% to 29% by weight of said surfactant.

11. The method of claim 1 including, said surfactant being a block copolymer selected from the group consisting of ethylene oxide and propylene oxide having M.W. of 1100–15,500, oxypropylene oxyethylene polyols derived from ethylene diamine.

* * * * *